US007543605B1

(12) United States Patent
Morando

(10) Patent No.: US 7,543,605 B1
(45) Date of Patent: Jun. 9, 2009

(54) DUAL RECYCLING/TRANSFER FURNACE FLOW MANAGEMENT VALVE FOR LOW MELTING TEMPERATURE METALS

(76) Inventor: Jorge A. Morando, 33125 Wintergreen Dr., Solong, OH (US) 44139

( * ) Notice: Subject to any disclaimer, the term of this patent is extended or adjusted under 35 U.S.C. 154(b) by 0 days.

(21) Appl. No.: 12/131,983

(22) Filed: Jun. 3, 2008

(51) Int. Cl.
*F16K 11/085* (2006.01)
*B22D 37/00* (2006.01)

(52) U.S. Cl. ..... 137/625.47; 222/318; 222/594; 266/236

(58) Field of Classification Search ..... 137/625.47; 222/205, 318, 405, 554, 594; 266/236, 239, 266/266; 164/437
See application file for complete search history.

(56) References Cited

U.S. PATENT DOCUMENTS 228,799 A * 6/1880 Aldrich ..... 222/554
1,448,529 A * 3/1923 Fleming ..... 222/554
5,016,446 A * 5/1991 Fiedler ..... 222/318
5,078,306 A * 1/1992 Keller et al. ..... 222/598
5,083,688 A * 1/1992 Luhrsen et al. ..... 222/598
5,547,014 A * 8/1996 Bruckner et al. ..... 164/437
5,637,541 A * 6/1997 Kuszyk et al. ..... 266/266
7,427,190 B2 * 9/2008 Baumgartner ..... 266/239

* cited by examiner

*Primary Examiner*—John Fox
(74) *Attorney, Agent, or Firm*—Steve M. Clemmons

(57) ABSTRACT

A furnace flow control valve for use within a bath of molten metal. The flow control valve includes a vertically-disposed elongated tubular stator, which is configured to receive flow from a molten metal pump. The valve has a rotor which is sealing rotatable within the stator between: a full re-circulation position, where flow from the pump passes un-hindered through the valve; a full transfer position, where flow from the pump is redirected into the vertically disposed stator and out of the valve; and a partial re-circulation/partial transfer position where flow from the pump both passes through the valve and is transferred up and out of valve through the stator.

18 Claims, 6 Drawing Sheets

DUAL RECYCLING/TRANSFER FURNACE FLOW MANAGEMENT VALVE FOR LOW MELTING TEMPERATURE METALS

FIELD OF THE INVENTION

The present invention relates to the transfer of molten metal and, more particularly, to the construction of a recycling furnace flow control apparatus including a molten metal immersible valve that re-directs the flow from a dual circulation/transfer pump from circulating a molten metal bath to transferring the molten metal out of the furnace.

BACKGROUND OF THE INVENTION

A typical molten metal facility includes a furnace with one or more pumps for moving molten metal. During the processing of molten metals, such as aluminum, the molten metal is normally continuously circulated through the furnace by a centrifugal impeller pump, i.e., a circulation pump, to equalize the temperature of the molten bath. A typical furnace includes a pump well that is located between the heating chamber or hearth and the charge well (where raw material is inserted into the furnace). These three main sections of a typical furnace are fluidly interconnected with the circulation pump causing the molten metal to circulate from the pump well to the charge well to the hearth and back into the pump well.

To transfer the molten metal out of the furnace, typically for casting the metal, a second transfer pump is used to elevate the metal up through a discharge conduit that runs up and out of the furnace. Once the furnace is empty or near empty, the transfer pump is shut down and new solid material is placed within the furnace to be melted.

Melting and transferring the metal in batches requires a significant amount of energy. This is particularly so due to the latent heat of fusion at the melting point. For example, the latent heat of fusion for aluminum is approximately 171 Btu/lb (397 kJ/kg). For a typical-sized furnace, e.g., having a 10,000 to 200,000 pound capacity, the amount of heat required to melt the next batch of aluminum would require between approximately 1.7 million to 34 million Btu just to raise the metal one degree Celsius at its melting point and cause the metal to change from solid to liquid.

To insure that the metal remains liquid after it is removed from the furnace and while it is transferred to the final casting processes/molds, the metal is normally heated far beyond its melting point (e.g., to approximately 1400° Celsius for aluminum, which has a melting point of approximately 66° Celsius).

One drawback of this traditional batch transfer process is that removing all of the molten metal from the furnace also removes all of the potential heat energy contained within the molten metal. In a continuous casting process, some of the molten metal is continually transferred out of the furnace to the molds, while most of the molten metal is re-circulated throughout the furnace. The heat energy of the molten metal is used to melt the solid raw material inserted into the furnace to replenish the molten metal being continually poured out.

In a molten metal re-circulating furnace, the pump well typically includes the circulation pump and, if there is enough space, a separate transfer pump. If there is not enough room in a particular furnace's pump well, the circulation pump must be removed and replaced with the transfer pump when retrieving/pouring molten metal from the furnace. While the current two pump system can be effective for its intended purpose, purchasing and maintaining two separate pumps is expensive and inefficient, particularly when the two pumps must be swapped out in smaller pump wells. Swapping out furnace pumps also prevents the furnace operator from utilizing a continuous casting process.

In a typical furnace, additional materials such as chlorine and nitrogen gas are injected into the metal at the pump outlet. The gas injection, however, causes both dross formation and violent shaking and vibrations in the immediate area where the injection occurs due to the rapid expansion of the gas. Further, it is well known that increasing the metal's flow rate facilitates gas injection into the molten metal. Typically, the pump velocity is increased briefly to increase the flow rate while injecting the gas, but running the pump at a higher than normal rate increases the risk of damaging the pump. This is particularly so when chlorine is being injected into the metal (aluminum) forming magnesium chloride dross.

There is therefore a need for a device that can be immersed in a bath of molten metal that can selectively redirect at least a portion of the output from the furnace's pump out of the furnace and which can control the flow rate of the re-circulating molten metal.

SUMMARY OF THE INVENTION

The energy cost to run a molten metal furnace in batches (where the furnace is loaded with solid material, the solid material is melted, and then the molten material is transferred out of the furnace) is expensive and time-consuming. The present invention provides the furnace operator the ability to choose to continue to circulate the molten metal through the furnace, while redirecting some of the metal up through the valve and out of the furnace for further processing. By retaining at least some of the "transfer-ready" molten metal within the furnace, the potential heat energy within that re-circulating metal can be tapped to increase the melting rate of any solid material being fed into the furnace.

The present invention provides a furnace flow control valve that is immersible in a flowing bath of molten metal, such as aluminum. The valve includes an elongated valve housing or stator which is mounted to the outlet of a re-circulation pump. The stator includes an inlet opening which receives the pump's output. A rotor is rotatably movable between a full re-circulation position, a partial transfer/partial re-circulation position, and a full transfer position to control the flow of the molten metal.

In the preferred embodiment, a molten metal transfer device is provided. The device includes a valve rotor that selectively redirects the output from a circulation pump from circulating the molten metal to elevating the molten metal up through the elongated cavity in the valve's stator which contains the rotor and out of a spillway formed in the upper end of the valve stator.

The present invention is intended to operate within a flow control system for a furnace containing a bath of molten metal that is selectively circulated within said furnace and/or transferred out of said furnace by a pump. Closing the valve fully redirects the entire pump's output into transfer conduits out of the furnace, while opening the valve fully causes the entire flow to re-circulate through the furnace. The valve may further be positioned to provide a dual-purpose, where some of the pump's output is transferred up and out of the furnace, while the remaining molten metal being pumped continues to re-circulate through the furnace.

It is an advantage of the present invention to provide a flow control valve that eliminates the need for two different pumps for re-circulating and transferring molten metal from a furnace. The flow control valve allows a single pump operating at its maximum efficiency (e.g., pumping 2000-3000 gallons per minute) to re-circulate a bath of molten metal within a furnace and to transfer the molten metal out of the furnace at a desired rate (e.g., 300 gallons per minute) by redirecting some of the flow from re-circulating into a transfer portion of the valve.

It is another advantage of the present invention that the valve allows adjustment of the transfer and recirculation flows to fit different needs and pump speeds.

It is still another advantage that present invention eliminates conventional transfer tube risers and elbows, whose restrictive size and ninety degree bends tend to leak and break due to the high velocity of the metal flow and the vibration in the pump.

It is yet another advantage of the present invention that the valve is placed immediately downstream from the pump outlet, effective to move the placement of any gas injection tubes further away from the pump. By injecting at the valve outlet rather than adjacent to the pump outlet, the valve receives the brunt of the vibration from the gas expansion and dross formation, rather than the pump. Further, the valve can be partially closed or "choked" to increase the flow rate from the pump to facilitate gas injection without increasing the velocity of the pump, allowing the pump to remain running at its maximum efficiency.

It is still yet another advantage of the present invention that the valve can be placed in a continuous casting position, which, in conjunction with the pump velocity, matches the transferred metal rate (per hour) to the furnace melting rate, eliminating the need to empty the furnace in batches.

These and other objects, features and advantages of the present invention will become apparent from the following description when viewed in accordance with the accompanying drawings and appended claims.

BRIEF DESCRIPTION OF THE DRAWINGS

The description refers to the accompanying drawings in which like reference characters refer to like parts throughout the several views, and in which.

DETAILED DESCRIPTION OF THE INVENTION

A conventional furnace is generally shaped as a fluid retaining enclosure. This enclosure includes a heating area or hearth, a pump well that contains a molten metal pump 5 and a charge well. A bath 7 of molten metal is contained within the furnace. A series of arches fluidly connect the hearth, pump well and charge well allowing the molten metal to flow through the furnace. During normal operation, the bath 7 is heated in the hearth, pulled into the pump well by pump 5 and accelerated out from the pump and into the charge well to circulate the molten metal through the furnace.

Pump 5 is typically a centrifugal impeller pump adapted to be immersed in molten metal. Pump 5 rotates an impeller to draw in and expel the molten metal forming bath 7. One example of such a pump is the type disclosed in my U.S. Pat. No. 7,326,028 entitled HIGH FLOW/DUAL INDUCER/HIGH EFFICIENCY IMPELER FOR LIQUID APPLICATIONS INCLUDING MOLTEN METAL, incorporated herein by reference. It should be appreciated that while pump 5 is being described as a centrifugal impeller-type of pump, it can be substantially any style pump suitable for use in a molten metal environment.

Figure 1:
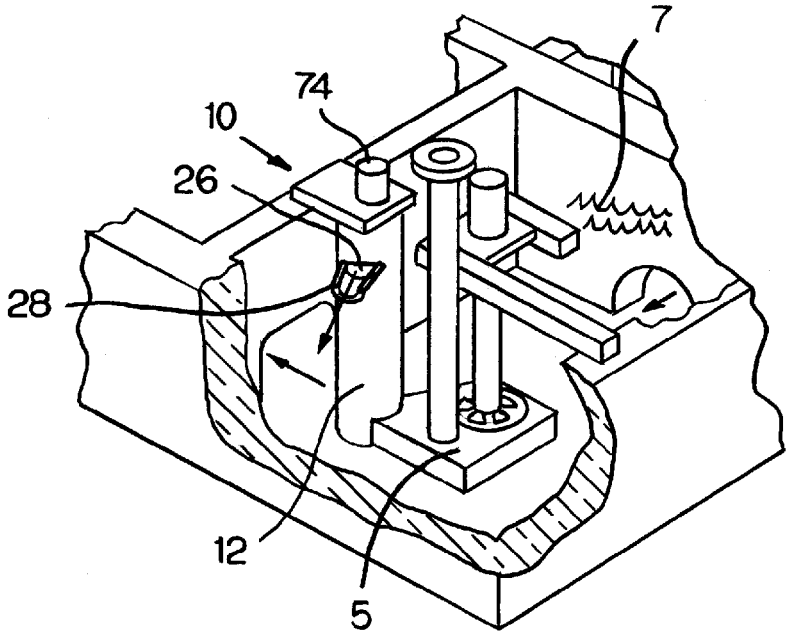
FIG. 1 is cut-away perspective view of the flow control valve in combination with a pump and placed within a typical re-circulation type furnace.
Figure 2:
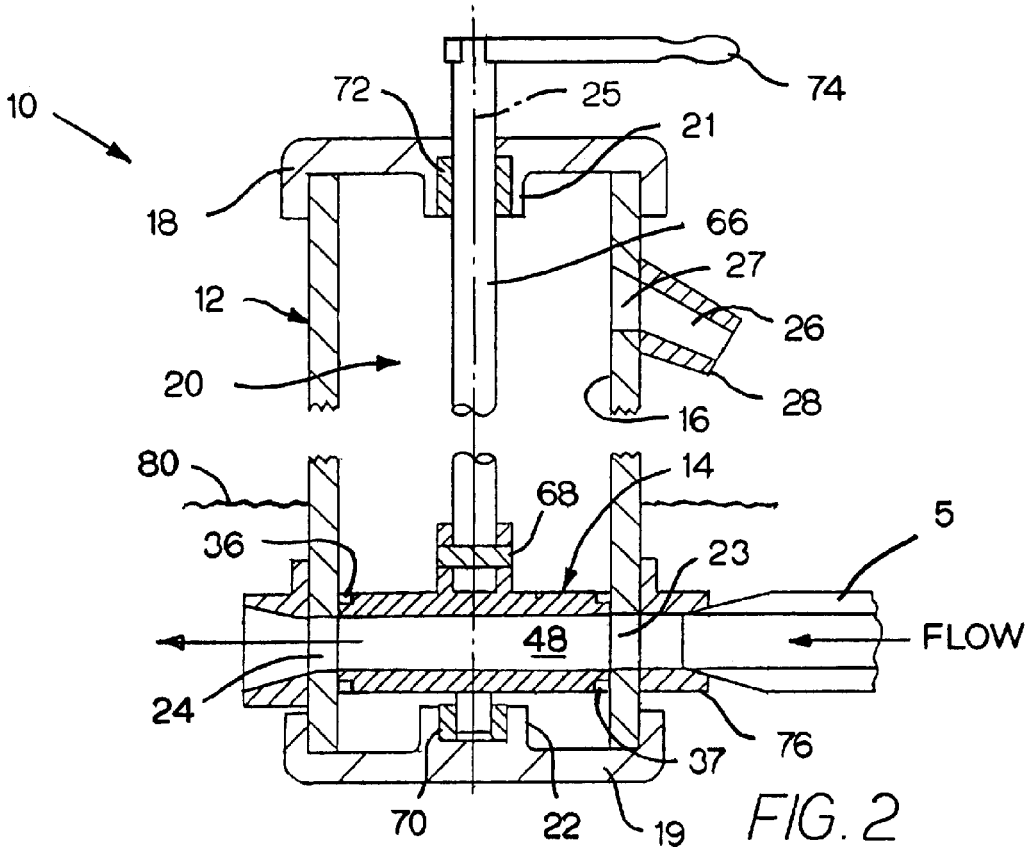
FIG. 2 is a side sectional view of the valve where the valve rotor is in a full re-circulation position.
Figure 3:
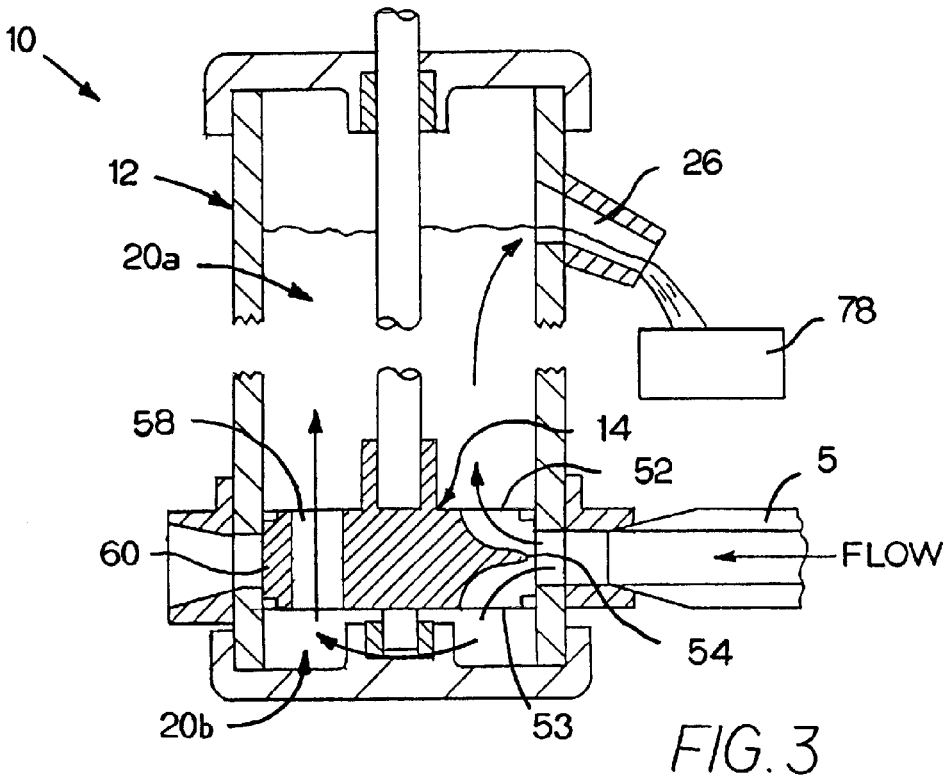
FIG. 3 is a side sectional view of the valve where the valve rotor is in a full transfer position.

Referring now to FIGS. 1-3, a preferred molten metal flow control valve 10 for a central melting or holding furnace is illustrated and comprises a valve housing body or stator 12 and a rotor 14 contained within the stator 12.

Stator 12 is a tubular shell having an elongated cylindrical inner wall 16. Stator 12 is preferably formed from a molten metal immersible material, such as graphite. Top and bottom covers 18 and 19, formed from substantially the same or similar materials as stator 12 cooperate with inner wall 16 to define an internal cavity or recess 20. Each cover 18, 19 includes a raised annular seat 21, 22 which is disposed concentric to the cylindrical inner wall.

A pair of aligned through bores 23, 24 are formed in the lower end of stator 12, i.e., near the bottom cover 19. Each bore 23, 24 passes through the stator 12, providing a passage between the outer surface of stator 12 and cavity 20. The upstream bore or inlet 23 and downstream bore or outlet 24 preferably run perpendicular to the longitudinal axis 25 of the cylindrical cavity 20.

A transfer opening 26 is formed in upper end of stator 12, near the top cover 18. Opening 26 includes a bore 27 through stator 12, which is in fluid communication with cavity 20. In the preferred embodiment, opening 26 includes a spout 28 which is angled or bends downwardly back toward the lower end of the stator. In this manner, and which will be described in greater detail below, molten metal rising within cavity 20 will automatically begin to pour from opening 26 once the level of the metal within cavity 20 reaches opening 26.

Referring now to FIGS. 2-6, rotor 14 is a generally cylindrical block 30 formed from a molten metal immersible material, such as graphite and is rotatably mounted within cavity 20. Block 30 is generally shaped as a cylinder having a top surface 31 and a bottom surface 32 spanned by an outer peripheral wall 33. An upper and lower annular seat 34 and 35 is formed in block 30 at top and bottom outer edges. Seats 34 and 35 receive a ceramic upper and lower ring seal 36, 37, respectively. Seals 36, 37 are fixed to block 30 with a refractory cement and are mounted concentric to the centerline or rotational axis 38 of the cylindrical block 30. Seals 36, 37 are sized to sealingly fit within cavity 20. That is, the outer surface 40 of the seals 36, 37 abut inner wall 16 to form a seal. To facilitate rotation of the rotor 14 within cavity 20, the outer surface 40 is polished or ground to slide along inner wall 16.

In the preferred embodiment, four vertical ceramic seals 42 run between the upper and lower seals 36, 37. Vertical seals 42 project beyond the outer surface 33 of the rotor block to abut inner wall 16 in substantially the same manner as ring seals 36, 37 (i.e., the outer surfaces of each seal 42 also abuts inner wall 16). Seals 42 are mounted within vertical channels 43 formed in the outer surface 33 and are oriented at ninety degree intervals about axis 38. A refractory cement material holds the seals 42 to the rotor block.

Vertical seals 42 divide the outer surface of block 30 into two sets of oppositely facing sections or lobes 44, 45 and 46, 47. As will be discussed in greater detail below, two of the oppositely facing lobes 44, 45 are configured to facilitate re-circulation of the molten metal bath 7, while the other two lobes 46, 47 are configured to transfer at least a portion of the molten metal out of the furnace.

Figure 4:
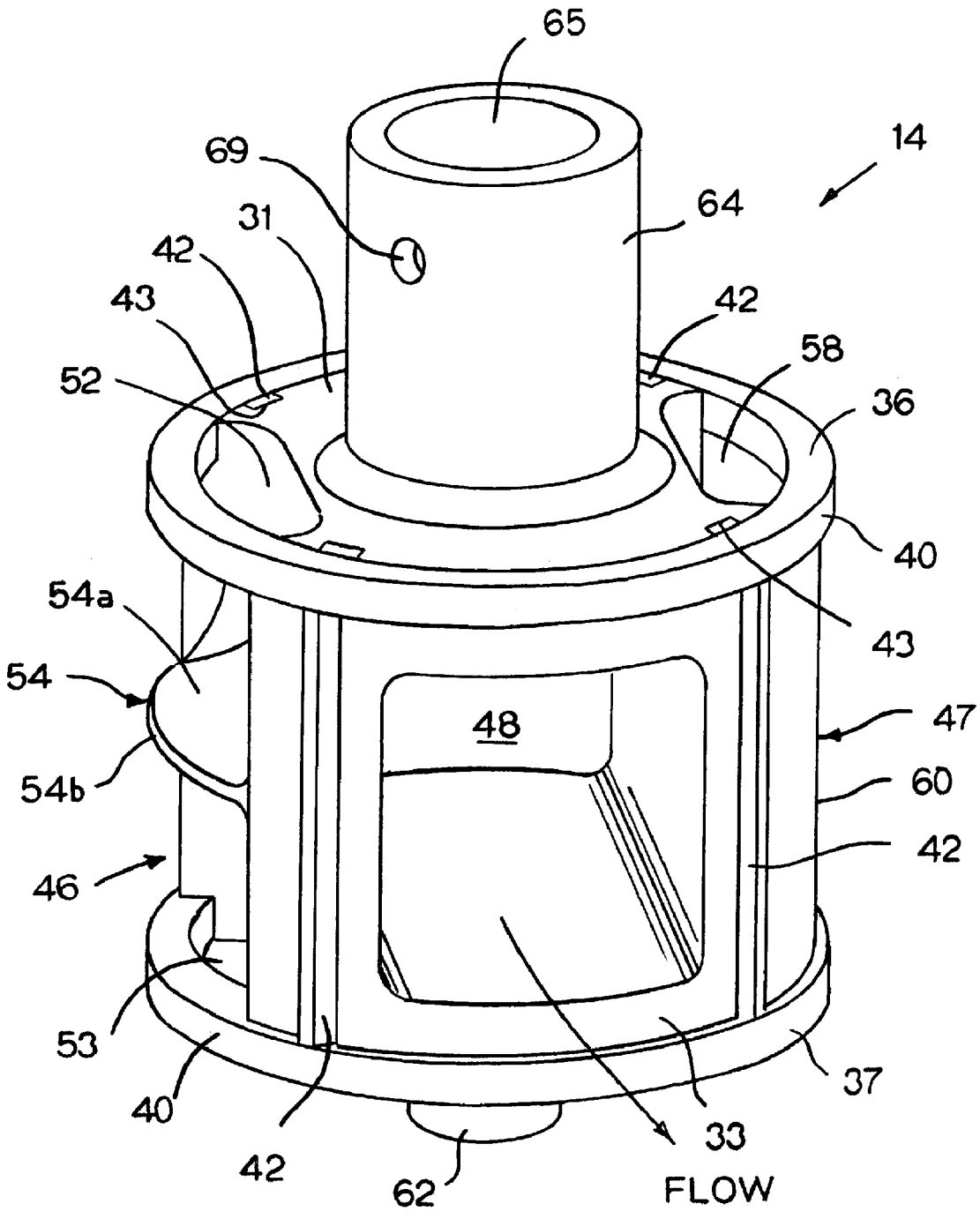
FIG. 4 is perspective view of the valve rotor.
Figure 5:
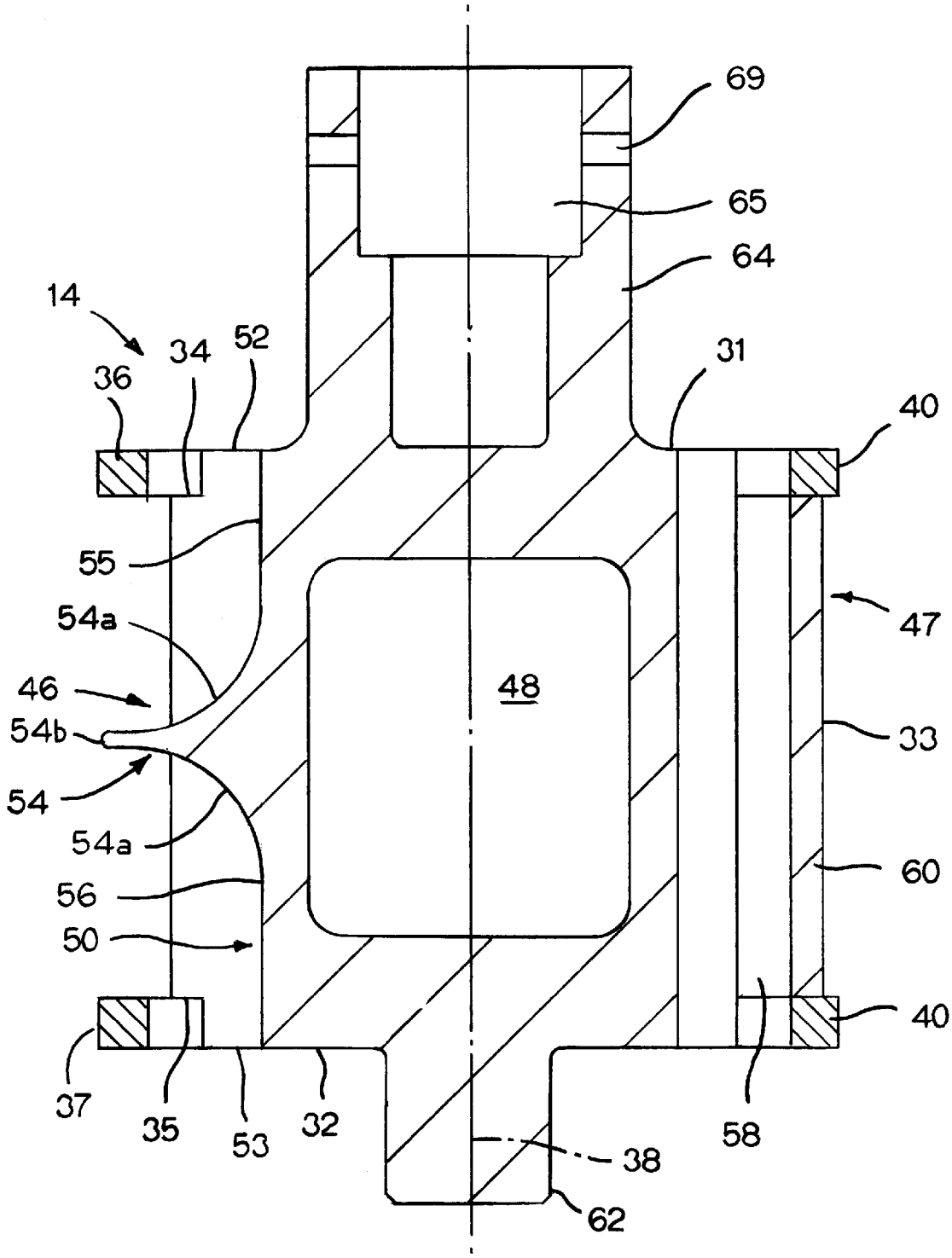
FIG. 5 is a side sectional view of the valve rotor looking down through the re-circulation passage.
Figure 6:
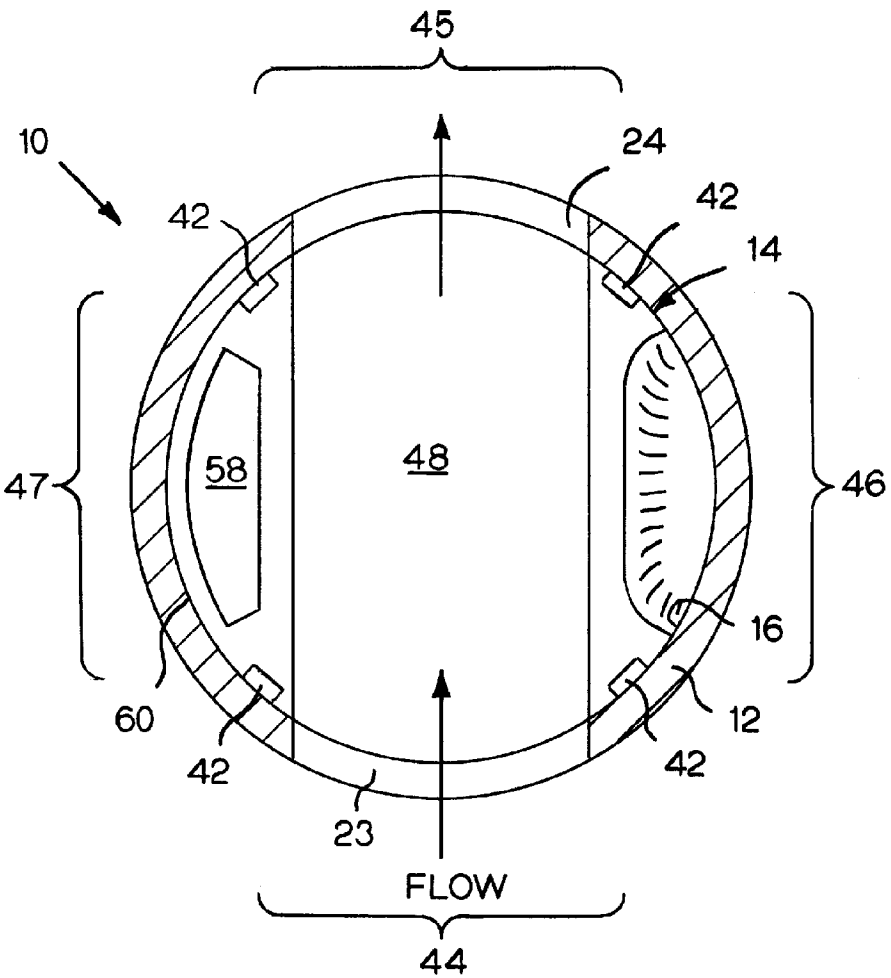
FIG. 6 is top sectional view of the valve where the valve rotor is in a full re-circulation position.

As shown best in FIGS. 4-6, rotor block 30 includes a molten metal re-circulation passage 48 that passes horizontally through block 30 between the two opposing re-circulation lobes 44, 45. Passage 48 has a shape and size suitable to receive the flow of molten metal emitted from pump 5. In the exemplary version illustrated in the FIGs., passage 48 has a rounded rectangle shape.

The upstream transfer lobe 46 includes a recessed redirection channel 50. Channel 50 traverses the height of block 30 from top surface 31 to bottom surface 32 forming an upper redirection opening 52 and a lower redirection opening 53 in these surfaces 31, 32. In the preferred embodiment, redirection channel 50 includes a raised lip 54 which projects from the radially innermost surface of the channel 50 dividing the channel's inner surface into upper and lower redirection surfaces 55 and 56, respectively. As shown in FIG. 5, lip 54 includes concave transitions or fillets 54*a* between the radially projecting lip and the vertical surfaces 55 and 56, to smoothly redirect the flow both upwardly through opening 52 and downwardly through opening 53. Lip 54 preferably extends radially from channel 50 to an outer edge 54*b* which follows the rounded shape of cylindrical outer wall 33 having a radius that is slightly less than that of ring seals 36, 37 and vertical 42.

The downstream transfer lobe 47 includes a vertical underfill passage or slot 58 which runs from between the upper and lower rotor block surfaces 31, 32. As shown in FIG. 6, slot 58, unlike redirection channel 50, is bounded by a containment wall 60 which follows block outer wall 33.

Rotor block 30 further includes means for pivoting the rotor about its centerline 38. In the preferred embodiment, a cylindrical plug or axle 62 extends concentrically along centerline 38 from bottom surface 32. Similarly, an annular ring 64 extends concentrically along centerline 38 from top surface 31. Ring 64 includes a internal recess 65 which is sized to receive a actuator rod or shaft 66. A locking pin 68 fixes shaft 66 within ring 64 through mounting holes 69.

As shown in FIGS. 2 and 3, rotor 14 is mounted within cavity 20 of stator 12 whereby seals 36, 37 and 42 abuttingly engage cylindrical inner wall 16, while axle 62 is telescopically inserted within lower seat 22. A heat resistant bearing 70 is mounted within lower seat 22 to rotatably mate the axle 62 to the stator. Rotor 14 is positioned within cavity 20 such that inlet 23 is coextensive with the output opening 5*a* of pump 5, effective to receive the entire flow from the pump 5.

Shaft 66 runs vertically upwardly through cavity 20, into annual upper seat 21 and through an aperture 71 in top cover 18 which is centered along axis 25. A second heat resistant bearing 72 is mounted within upper seat 21 to rotatably mate the upper portion of shaft 66 to the stator. Shaft 66 is mounted to an actuator 74, such as a step motor, handle, or hand wheel that causes shaft 66 and rotor 14 to rotate about axis 25 within stator 12.

It should be appreciated that the size and shape of valve 10 may vary to receive the flow of molten metal exiting a pump 5. Particularly, the elongated body 12 and its vertical cavity 20 are of sufficient height to place transfer opening 26 in a position to allow a user to channel or transfer the molten metal being redirected out of the valve 10 when rotor 14 is turned to either a partial or full transfer position. Further, rotor re-circulation passage 48 and its complementary inlet 23 and outlet 24 are sized to receive the full output of pump 5 with little to no restriction to the flow when the rotor 12 is placed in the full re-circulation position.

As best shown in FIGS. 2 and 3, rotor 14 is positioned within cavity 20, such that a cavity 20 is divided between an upper cavity 20*a* and a lower cavity 20*b*. Upper cavity is bounded at its upper end by top cover 18 and at its lower end by top surface 31. Lower cavity 20*b* is bounded at its upper end by bottom surface 32 and at its lower end by bottom cover 19. The upper and lower cavities 20*a*, 20*b* are fluidly connected by vertical slot 58.

Stator 12 and rotor 14 are preferably formed from a material suitable for immersion in molten aluminum, such as graphite or a ceramic material, such as silicon carbide or silicon nitride reaction bonded silicon carbide. In a preferred embodiment, both stator 12 and the rotor block 30 are formed from graphite while seals 36, 37, and 42 are formed from a ceramic material to facilitate the sliding interface between the surfaces 16 and 40. In other embodiments, stator 12 and block 30 may be coated in a boron nitride paint which is highly resistant to molten aluminum and zinc and possesses a low coefficient of friction to facilitate sliding.

Referring now to FIGS. 2 and 3, valve 10 is mounted immediately downstream from the outlet 5*a* of re-circulation pump 5. In one preferred embodiment, pump outlet 5*a* is fluidly interconnected to valve inlet 23 by a tubular union 76 or other means for fluidly mating an upstream conduit to a separate downstream conduit. In one embodiment, the outer body of stator 12 includes additional interconnecting structure(s) for mating valve 10 to pump 5.

In operation, rotor 14 is rotatably movable within stator 12 to control the flow emitted from pump 5 and received through inlet 23. Particularly, rotor 14 is movable from a full re-circulation position (i.e., re-circulation only), shown best in FIGS. 2, 6 and 7 to a full transfer position (i.e., transfer only), shown best in FIGS. 3, 8 and 9. FIGS. 10 and 11 illustrate a partial re-circulation/partial transfer position where flow passes through both the re-circulation passage 48 and up through cavity 20 and out transfer opening 26.

Figure 7:
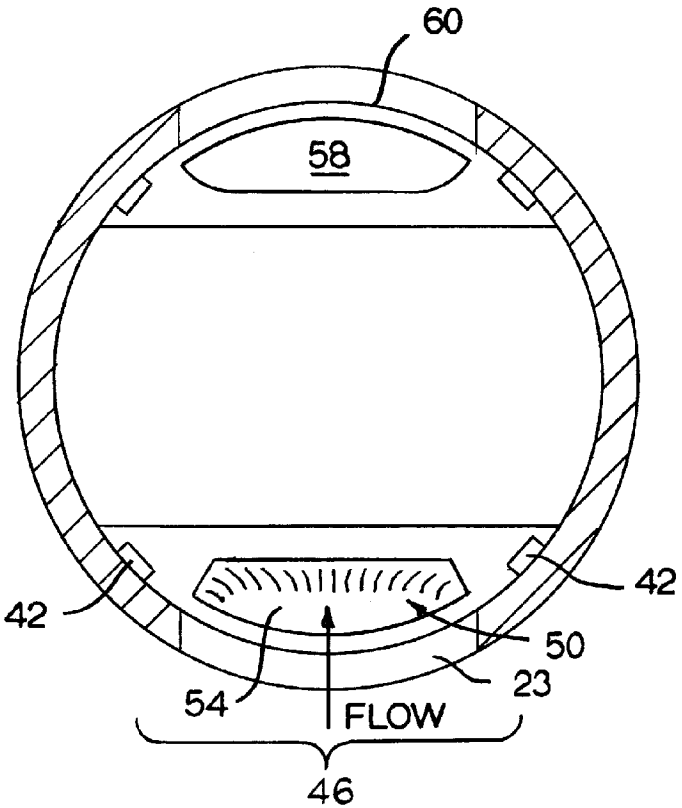
FIG. 7 is top sectional view of the valve where the valve rotor is in a full transfer position.

Referring now to FIGS. 2, 6 and 7, valve 10 is illustrated in the full re-circulation position, where rotor 14 is positioned such that re-circulation passage 48 is aligned with stator inlet 23 and outlet 24. In this manner, flow coming out of pump 5 passes directly through valve 10 without restriction. In one embodiment, the side walls of passage 48 are substantially co-planar with the side walls of both inlet 23 and outlet 24.

Figure 8:
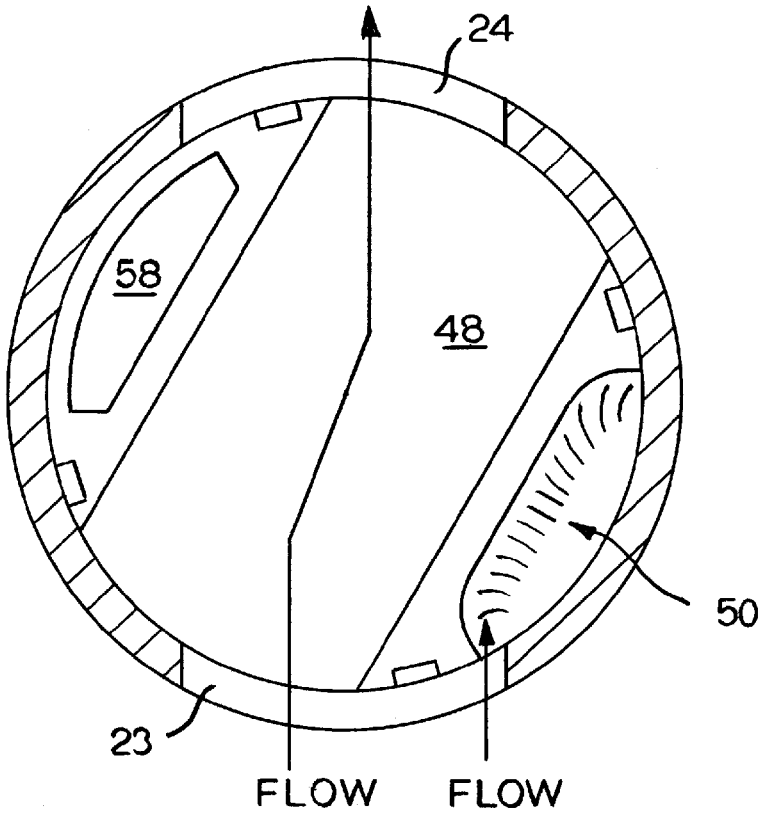
FIG. 8 is top sectional view of the valve where the valve rotor is in a partial re-circulation/partial transfer position.
Figure 9:
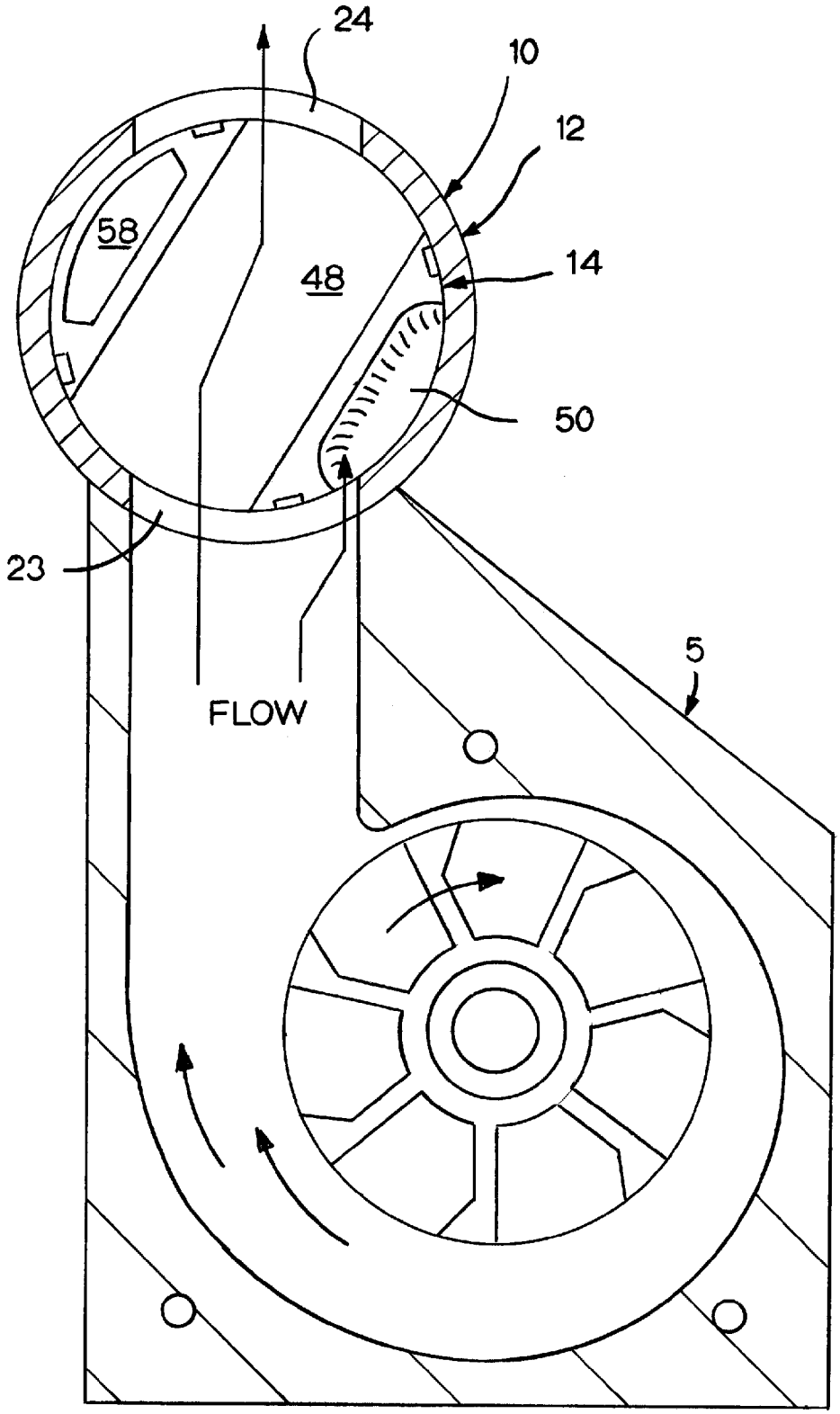
FIG. 9 is a top sectional view of the valve in combination with a furnace pump, where the rotor is in a partial re-circulation/partial transfer position.

Referring now to FIGS. 3, 8 and 9, valve 10 is illustrated in the full transfer position, where rotor 14 is positioned such that redirection lobe 46 is aligned with and faces inlet 23. As best shown in FIG. 3, flow coming out of pump 5 is redirected vertically in both an upwards and a downward direction, such that the flow is diverted directly into upper cavity 20*a* through opening 52 and into lower cavity 20*b* through opening 53. The flow passing into lower cavity 20*b* will fill cavity 20*b*, flowing around seat 22 and axle 62. Once cavity 20*b* is filled, the molten metal contained therein begins to rise up toward upper cavity 20*a* through slot 58. As more molten metal is received by valve 10, upper cavity 20*a* begins to fill. Once the molten metal reaches the location of transfer opening 26 and spout 28, the molten metal begins to transfer out of valve 10 (and the furnace containing the valve) into a transfer conduit/tundish 78.

It should be appreciated that splitting the pump's output of molten metal by both directly channeling of the molten metal into the upper cavity 20*a* and by under-filling the upper cavity 20*a* through the remaining diverted molten metal balances the flow forces within valve 10, which greatly reduces the amount of head required to lift the molten metal up through the elongated vertical cavity 20*a*. Further the downward angling of the transfer opening 26 and spout 28 allows gravity to transfer the molten metal away from the valve and furnace, thereby eliminating the need for another elbow (i.e., a restriction point which requires additional head pressure) ordinarily found in a transfer conduit.

Referring now to FIGS. 10 and 11, valve 10 is illustrated in a "dual-purpose" position, where the rotor is in a partial re-circulation/partial transfer position. In this dual-purpose position, rotor 14 is rotated such that both re-circulation passage 48 and redirection lobe 46 are at least partially aligned with inlet 23. Placing the rotor 14 in this dual-purpose position causes both the re-circulation passage 48 and the redirection channel 50 to receive flow coming from pump 5.

In this dual-purpose position, the valve 10 is capable of continuous casting, where some of the molten metal is transferred out of the furnace via redirection channel 50, under-fill slot 58, and transfer opening 26, while the remaining molten metal continues to re-circulate through the furnace passing through re-circulation passage 48.

In this manner, valve 10 may be placed in the dual-purpose transfer/recirculation position very gradually where the rotor 14 is turned from the full recirculation position only enough to begin to redirect a relatively small amount of molten metal into channel 50. This enables a furnace operator to very slowly begin to fill the elongated upper cavity 20*a* with molten metal to gradually heat the walls of the stator 12 and valve shaft 66. This gradual heating of the valve components, particularly the components not continually immersed in the molten metal (i.e., the components normally located above the metal line or level 80 of the molten metal bath 7 found in the furnace), greatly reduce the likelihood of these components from failing due to thermal shock.

This "throttling" feature of valve 10 in the dual-purpose rotor position further permits greater flexibility to the furnace operator in choosing the amount and speed of the molten metal being transferred out of the furnace. By taking into account the pump speed/output along with the desired transfer rate, an operator can rotate rotor 14 to cause more or less flow to enter redirection channel 50, thereby controlling the amount of molten metal being transferred out of the valve/furnace. In a continuous casting operation, the operator can throttle the rotor 14 to set the amount being transferred equal to the amount being melted, thereby using the re-circulating molten metal to increase the melting rate of the solid raw material added to the furnace.

From the foregoing description, one skilled in the art will readily recognize that the present invention is directed to: a dual-purpose valve that is configured to selectively re-circulate molten metal within a furnace, transfer the molten metal from the furnace, and a combination of both re-circulating and transferring the molten metal; and methods for proportionally transferring molten metal from a furnace with a valve immersed in a bath of molten metal mounted immediately downstream from the furnace's re-circulation pump.

While the present invention has been described with particular reference to various preferred embodiments, one skilled in the art will recognize from the foregoing discussion and accompanying drawing and claims that changes, modifications and variations can be made in the present invention without departing from the spirit and scope thereof as defined in the following claims.

What is claimed is:

1. A furnace flow control valve, immersible in a flowing bath of molten metal, comprising:

a stator having an vertical cylindrical inner wall which defines an elongated cavity, wherein a lower end of said inner wall includes aligned recirculation inlet and outlet openings and an upper end of said inner wall includes a transfer opening; and a rotor which is rotatably received within said cavity, said rotor including a recirculation passage running horizontally therethrough, and means for transferring said flowing bath by redirecting at least some of said flowing bath into said cavity and out of said transfer opening.

2. A furnace flow control valve as defined in claim 1, wherein said rotor is movable from:

a re-circulation position where said flowing bath enters said inlet opening, flows through said re-circulation passage, and exits out of said outlet opening; and a partial re-circulation, partial transfer position where some of said flowing bath entering said inlet opening flows through said transferring means, while the remaining molten metal entering said inlet opening flows through said re-circulation passage and out of said outlet opening.

3. A furnace flow control valve as defined in claim 2, wherein said transferring means includes a vertical redirection channel traversing an outer face of said rotor.

4. A furnace flow control valve as defined in claim 3, wherein said rotor separates said cavity into an upper cavity and a lower cavity, and wherein said redirection channel is in fluid communication with both of said upper and lower cavities.

5. A furnace flow control valve as defined in claim 4, wherein said re-circulation passage bisects said rotor into an upstream transfer portion and a downstream transfer portion, and wherein said redirection channel is located in said upstream transfer portion, said transferring means further comprising: an under-fill slot running vertically through said downstream transfer portion, said slot fluidly interconnecting said upper cavity with said lower cavity.

6. A furnace flow control valve as defined in claim 5, wherein said redirection channels directs some of said molten metal directly into said upper cavity and some of said molten metal into said lower cavity when said rotor is in said partial re-circulation, partial transfer position;

wherein said molten metal flows through said under-fill slot and into said upper cavity when said lower cavity is filled with molten metal.

7. A furnace flow control valve as defined in claim 2, further comprising: sealing means, which slidably abut said inner wall and sealingly separate said cavity from said re-circulation passage and said re-circulation passage from said transferring means when said rotor is in said re-circulation position.

8. A furnace flow control valve, immersible in a flowing bath of molten metal, comprising:

a stationary housing having an elongated cavity defined by a vertical cylindrical inner wall, wherein a lower end of said cavity is in fluid communication with an inlet opening and a recirculation outlet opening, and an upper end of said cavity is in fluid communication with a transfer outlet opening, wherein said inlet opening receives said flowing bath;

a rotor having a generally cylindrical body which is rotatably received within said cavity, said body including a recirculation passage running horizontally therethrough and upstream and downstream transfer channels running substantially vertically through said rotor on opposite sides of said recirculation passage, wherein said upstream transfer channel is formed in the outer face of said rotor and said downstream transfer channel is contained internally within said body; and means for rotating said rotor within said cavity from a full recirculation position where said recirculation passage is in fluid communication with only said inlet opening and said recirculation outlet opening to a transfer position wherein said upstream transfer channel is in fluid communication with said inlet opening.

9. A furnace flow control valve as defined in claim 8, further comprising a lip which extends from the radially innermost surface of said upstream transfer channel and separates said upstream transfer channel inner surface into upper and lower redirection channels.

10. A furnace flow control valve as defined in claim 9, wherein said rotor is mounted within said cavity such that said lower redirection channel is in fluid communication with said downstream transfer channel.

11. A furnace flow control valve as defined in claim 10, wherein said transfer position is a partial recirculation/partial transfer position wherein both said recirculation passage and said transfer channels are in fluid communication with said inlet opening.

12. A furnace flow control valve as defined in claim 9, further comprising a plurality of molten metal immersible seals mounted vertically along the outer surface of said rotor, wherein at least two seals are mounted adjacent to an inlet of said recirculation passage and fluidly separate said recirculation passage from said upstream transfer channel when said rotor is in said full recirculation position.

13. A furnace flow control valve as defined in claim 12, wherein said transfer position is a partial recirculation/partial transfer position wherein said rotor is positioned within said cavity such that one of said seals is directly downstream from said inlet opening such that said flowing bath passes the seal and both said recirculation passage and said transfer channels receive a portion of said flowing bath.

14. A system for selectively recirculating and transferring a bath of molten metal, comprising:

pump means that causes said bath of molten metal to flow;

an tubular vertical stator that is mounted adjacent to an outlet of said pump means, said stator including an elongated cavity defined by a cylindrical inner wall and a floor, an inlet opening fluidly couples the pump outlet to the cavity, said stator further including a recirculation outlet opening in said inner wall downstream from said inlet opening and a transfer outlet opening in said inner wall located vertically above both said inlet opening and said recirculation outlet opening;

a rotor that is rotatably and sealing mounted within said cavity, said rotor having a generally cylindrical outer surface and has a recirculation passage passing substantially horizontally therethrough, said rotor also including a bifurcated redirection channel formed in and running substantially vertically along the outer surface, an under-fill slot passing substantially vertically through the rotor on the opposite side of said recirculation passage from said redirection channel; and means for selectively rotating said rotor within said cavity from a full recirculation position where said recirculation passage is in fluid communication with only said inlet opening and said recirculation outlet opening to a transfer position wherein said redirection channel is in fluid communication with said inlet opening.

15. A system as defined in claim 14, further comprising a plurality of seals mounted to the outer surface of the rotor, said seals abutting said inner wall when said rotor is in said cavity, wherein at least one of said seals is mounted adjacent to an inlet of said recirculation passage and fluidly separates said recirculation passage from said redirection channel when said rotor is in said full recirculation position.

16. A system as defined in claim 15, wherein said flow of molten metal passes said at least one seal adjacent to said recirculation passage inlet when said rotor is in said transfer position.

17. A system as defined in claim 14, wherein said rotor separates said cavity into an upper cavity and a lower cavity, and wherein said redirection channel is in fluid communication with both of said upper and lower cavities.

18. A system as defined in claim 17, wherein said redirection channel directs some of said molten metal directly into said upper cavity and some of said molten metal into said lower cavity when said rotor is in said transfer position;

wherein said molten metal flows through said under-fill slot and into said upper cavity when said lower cavity is filled with molten metal.

* * * * *